United States Patent [19]

Schulte

[11] Patent Number: 4,747,253

[45] Date of Patent: May 31, 1988

[54] METHOD AND AN APPARATUS FOR THE PROPORTIONING OF THE CONTENTS DURING THE MANUFACTURE OF PACKING CONTAINERS

[75] Inventor: Diethard Schulte, Hochheim/Main, Fed. Rep. of Germany

[73] Assignee: Tetra Pak International AB, Lund, Sweden

[21] Appl. No.: 39,764

[22] Filed: Apr. 17, 1987

Related U.S. Application Data

[63] Continuation of Ser. No. 819,480, Jan. 16, 1986, abandoned, which is a continuation of Ser. No. 532,482, Sep. 15, 1983, abandoned.

[30] Foreign Application Priority Data

Sep. 27, 1982 [SE] Sweden ..... 8205496

[51] Int. Cl.[4] ..... B65B 9/10; B65B 3/26

[52] U.S. Cl. ..... 53/433; 53/79; 53/451; 53/511; 53/551; 53/554; 53/567; 426/410

[58] Field of Search ..... 53/79, 403, 432, 433, 53/451, 510, 511, 551, 552, 554, 567; 426/392, 397, 410, 418

[56] References Cited

U.S. PATENT DOCUMENTS

| | | | |
|---|---|---|---|
| 2,926,087 | 2/1960 | Rickers | 426/477 |
| 3,325,961 | 6/1967 | Lindh et al. | 53/551 |
| 3,423,902 | 1/1969 | Stroop | 53/511 |
| 4,081,944 | 4/1978 | Stöstrand | 53/51 |
| 4,347,695 | 9/1982 | Zobel et al. | 53/432 |
| 4,384,438 | 5/1983 | Hilmerson | 53/551 |

FOREIGN PATENT DOCUMENTS

| | | |
|---|---|---|
| 2931527 | 4/1980 | Fed. Rep. of Germany . |
| 1155504 | 6/1969 | United Kingdom . |
| 239103 | 3/1969 | U.S.S.R. . |
| 405772 | 11/1973 | U.S.S.R. . |
| 526548 | 8/1976 | U.S.S.R. . |

*Primary Examiner*—Robert L. Spruill
*Assistant Examiner*—Donald R. Studebaker
*Attorney, Agent, or Firm*—Burns, Doane, Swecker & Mathis

[57] ABSTRACT

The manufacture of non-returnable packages for e.g. milk is frequently carried out by the conversion of web-shaped, laminated packing material to a tube, filling of the tube with milk and sealing and forming to filled packing containers of the desired, e.g. parallelepipedic, shape. During the forming, which is done by means of external forming devices, the contents are made use of as an internal mandrel or a holder-up for the forming devices, so that the desired shape can be achieved without creasing or other deformations. The above-mentioned forming principle works less well if the packing containers are not to be completely filled but have a certain air space or headspace. The proportioning of the contents also becomes uncertain and the desired accuracy of volume cannot always be achieved. These difficulties are overcome if the contents are mixed prior to filling with gas, preferably sterile air, in appropriate proportions, so that the contents obtain a foam-like character, using a gas volume which is in a suitable proportion to the air space of the finished packing container. The invention relates to a method and apparatus for proportioning the contents in the manufacture of packing containers.

12 Claims, 2 Drawing Sheets

METHOD AND AN APPARATUS FOR THE PROPORTIONING OF THE CONTENTS DURING THE MANUFACTURE OF PACKING CONTAINERS

This application is a continuation of application Ser. No. 819,480, filed Jan. 16, 1986, which was a continuation of Ser. No. 532,482, filed Sept. 15, 1983, both now abandoned.

BACKGROUND AND SUMMARY OF THE INVENTION

The present invention relates to a method and apparatus for proportioning the contents in the manufacture of packing containers formed from tubular, flexible packing material. More specifically, the present invention relates to a method and apparatus for proportioning contents which are fed to a container which is then flattened, sealed and cut off below the surface of the contents.

Packing containers for e.g. milk or other, in particular liquid, foodstuffs are manufactured generally from laminated, flexible material which comprises layers of paper and thermoplastics. A known packing container is formed in that a laminate web, while being fed through the packing machine, is successively converted to tubular shape by joining together its two longitudinal edges and sealing them to one another in a liquid-tight manner. The tube so formed is moved substantially vertically downwards through the machine at the same time as contents are furnished via a fill pipe introduced into the upper, open end of the tube and extending downwards inside the tube. At the lower end of the tube the machine is provided with reciprocating processing jaws, co-operating with one another, which press together the passing material tube at regular intervals so that transverse flattened zones are produced wherein the walls of the material tube are sealed to one another in a liquid-tight manner. The transverse sealing of the material tube takes place below the level of the contents, and the tube is thus converted to coherent, substantially cushion-shaped packing containers which are completely filled with contents. After the cushion-shaped packing containers have been separated from one another through cuts in the transverse sealing zones, a final form-processing takes place so that the packing containers obtain the desired, e.g. parallelepipedic shape.

During the flattening of the packing material tube as well as the subsequent form-processing for converting the cushion-shaped packing containers to parallelepipedic shape, the contents are used as an internal "mandrel" or holder-up in the packing container. That is, the contents generate the internal back pressure which is necessary for making possible the forming of the packing container without undesirable deformation.

The principle of making use of the contents as a holder-up in the forming process has worked excellently up to now, since the packing containers have been manufactured so as to be completely filled with incompressible liquid contents, that is to say without air space. If packing containers with air space (so-called headspace) are to be manufactured, the contents do not produce the same well-defined and stable back pressure over the whole surface of the packing container and this increases the risk of creasing or other deformations. The technique of manufacture described above has proved less appropriate up to now, therefore, for the manufacture of packing containers of the partially filled type.

It is an object of the present invention to overcome the above-mentioned disadvantages and to provide a technique which makes it possible to manufacture and form partially filled packing containers with satisfactory results without having the packing containers being incompletely shaped or deformed.

It is a further object of the present invention to provide a method making possible an accurate proportioning of the quantity of contents in each packing container.

It is a further object of the present invention to provide a method which can be used in existing packing machines without appreciable complication.

These and other objects have been achieved in accordance with the invention in that a method for proportioning contents includes the mixing of the contents with gas prior to being fed into the packing material tube.

It is also an object of the present invention to provide an apparatus for proportioning contents which is simple and reliable in operation and capable of being combined with known types of packing machines.

These and other objects have been achieved in accordance with the invention in that an apparatus for proportioning contents includes a gas feed pipe which is joined to the fill pipe at some distance from the opening of the fill pipe.

The method and the apparatus in accordance with the invention provide a number of advantages in that they overcome the aforementioned disadvantages and make is possible to utilize known principles of package forming for the manufacture of packing containers which are only partially filled with contents. The volume of contents can be regulated in each individual packing container with great accuracy in a simple manner through variation of the quantity of gas fed. By choosing a suitable type of gas which is not harmful to the product, the method can be used with practically all types of contents.

BRIEF DESCRIPTION OF THE DRAWINGS

A preferred embodiment of the method as well as of the apparatus in accordance with the invention will now be described in more detail with special reference to the enclosed schematic drawings in which like elements bear like reference numerals, and wherein.

DETAILED DESCRIPTION OF THE PREFERRED EMBODIMENT

Figure 1:
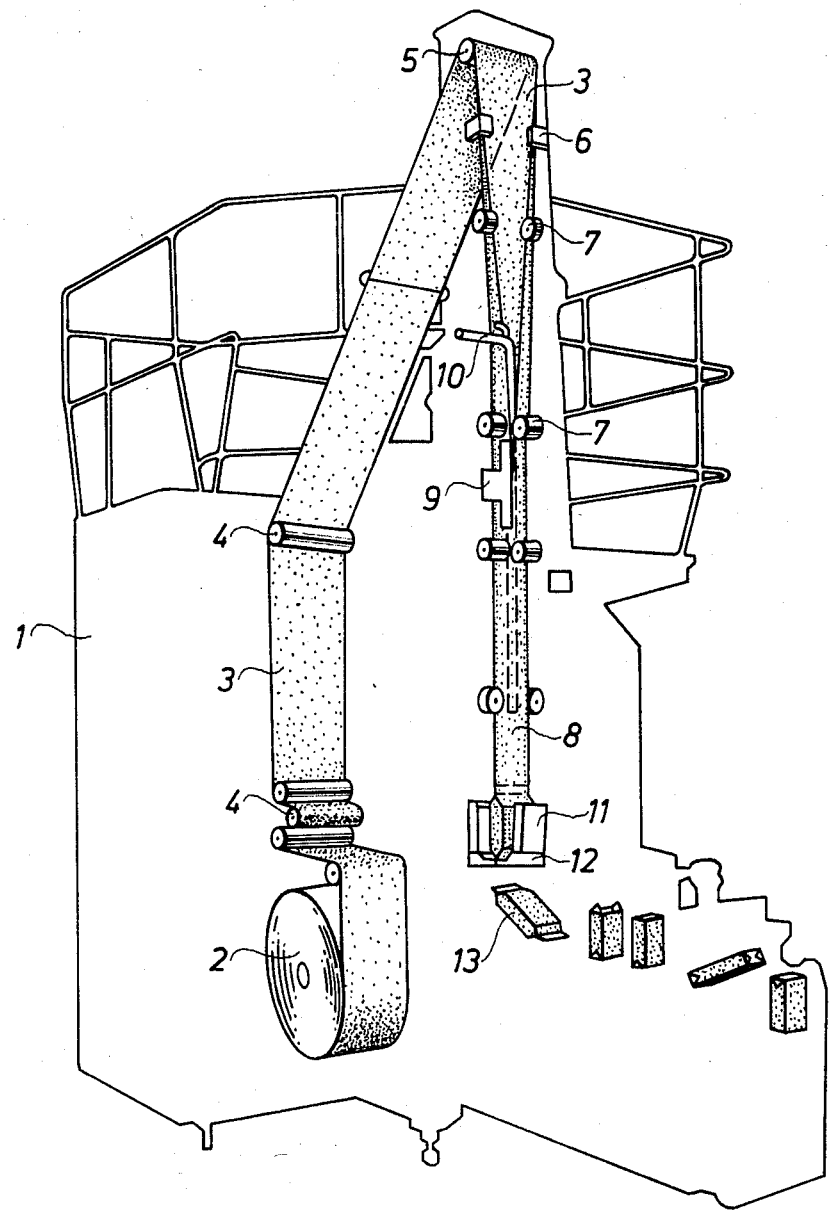
FIG. 1 is a schematic view of the conversion of a web-shaped packing material to individual packing containers in a known type of packing machine and FIG. 2 is an enlarged schematic cross-sectional view of the conversion of a packing material tube to individual packages according to the invention.

The packing machine indicated in FIG. 1 is of the previously known type which converts web-shaped packing material to individual packing containers. The packing laminate generally comprises a central carrier layer of paper which is coated on either side with thin, liquid-tight layers of thermoplastic material, e.g. polyethylene. The packing laminate is provided with crease lines in order to facilitate folding and conversion to finished packing containers. The laminate is fed to the packing machine 1 in the form of a roll 2 which is suspended so that it can rotate in the magazine of the packing machine. From the magazine the packing material web 3 runs via a number of guide rollers 4 to the upper part of the machine where it runs over a reversing roll 5 to continue thereafter substantially vertically downwards through the packing machine.

With the help of various folding and forming elements 6,7 arranged along the path of movement of the material web 3, the packing material web 3 during its downward movement through the machine is successively converted to tubular form. In operation, the web 5 two longitudinal edges are guided towards each other and are sealed together so that a material tube 8 with a longitudinal, liquid-tight seal is produced. The sealing together of the two longitudinal edges is achieved through the supply of heat by a hot-air nozzle 9, by means of which the parts of the thermoplastic layers located at the edges are induced to melt. The two longitudinal edges are then pressed together while they are being cooled thus causing the thermoplastic layers to be joined together, so that the desired, wholly liquid-tight joint is produced.

Figure 2:
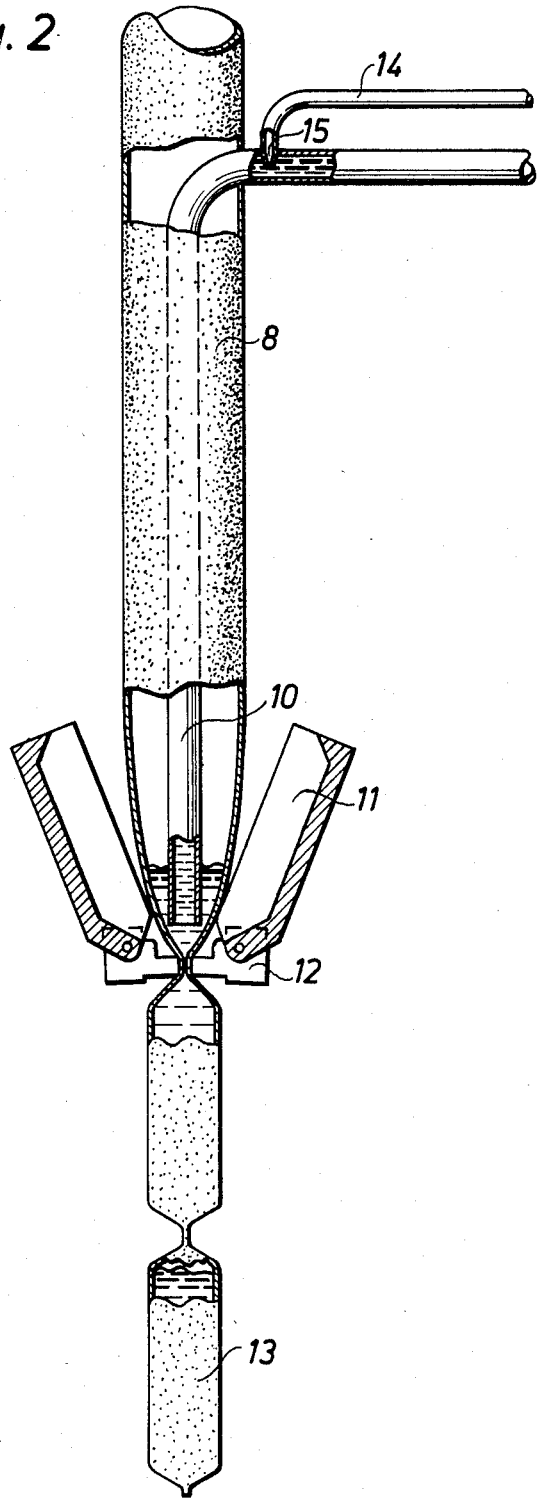

The packing material tube 8 so formed is filled thereafter with contents via a fill pipe 10 which extends through the upper, open end of the packing material tube 8. The fill pipe then runs substantially concentrically downwards through the packing material tube and opens at a little distance above the bottom end of the same. At some distance below the opening of the fill pipe 10, forming and sealing jaws 11,12 (FIG. 2) arranged on either side of the packing material tube 8 are provided which are adapted so that they process the packing material tube in pairs between themselves. For the sake of clarity only one set of forming and sealing jaws is shown in the figure, while in practice usually a further number of jaws is provided which alternately process the packing material tube.

The sealing jaws 12 are moved continuously in a direction towards and away from each other so that they compress and seal the packing material tube along transverse sealing zones at regular intervals while at the same time displacing the contents. The sealing jaws 12 are moved at the same time in a vertical direction so that when they are in the upper turning position they are moved towards each other and compress and retain the packing material tube. In the subsequent movement downwards through the packing machine, the walls of the packing material tube are compressed and welded together, the material tube at the same time being drawn forward over a distance which corresponds to the length of one packing container blank. During the downward movement, the two forming jaws 11 are swivelled towards each other at the same time so that the part of the packing material tube 8 which is situated directly above the sealing jaws 12 is partly compressed and formed to the desired shape which may be substantially cushion-shaped with a rectangular cross-section. When the sealing jaws 12 have reached their bottom position the forming jaws 11 are swivelled out again to the position shown in FIG. 2. At the same time, the material tube 8 is cut off by means of a transverse cut in the zone compressed by the sealing jaws. As a result a previously formed packing container 13 will be detached from the packing material tube. The packing container 13 is then transported further with the help of a conveyor, not shown, for continued processing and final shaping so that a packing container of the desired shape (in this case parallelepipedic) is produced.

As mentioned earlier, the desired contents are fed to the bottom end of the packing material tube 8 via the fill pipe 10. In the continuous operation of the packing machine and manufacture of wholly filled packages, the contents are fed in such quantities that the level of the contents is always situated above the region wherein the packing containers are sealed off and formed. This ensures that the packages will be completely filled with contents, and makes possible the forming of the container, since in order to achieve a satisfactory forming it is necessary to make use of the internal back pressure which is created by the liquid present in the packing container.

In the manufacture of partially filled packing containers having an air space, it has been advantageous to feed the contents in such quantities to each packing container so that the desired air space is created. This proportioned feed means that an air space is generated in the upper end of the packing container which means that during the form-processing the back pressure caused by the contents varies in different parts of the packing container, so that the forming will be uncertain and the risk of faults e.g. crease formation, will increase strikingly.

In accordance with the invention partially filled packing containers are manufactured by the continuous feed of contents through the fill pipe 10, these contents, however, having been mixed with gas prior to the feed to the packing material tube 8. The apparatus in accordance with the invention includes a gas feed pipe 14 which is joined to the fill pipe 10 at some distance before the opening of the fill pipe 10. In a preferred embodiment, the gas feed pipe 14 is joined to the fill pipe 10 approximately at the part of the fill pipe 10 which is located outside the packing material tube 8. To improve the mixing in of gas with the contents and to obtain the desired size of gas bubbles, the gas feed pipe is appropriately provided with a nozzle 15 at the point where it joins the fill pipe.

When it is intended that the machine should manufacture packing containers which are only partially filled, the contents are fed continuously in such a rhythm that during operation the level of contents remains substantially in the desired position at some distance above the forming station, which is regulated by a float-controlled valve. At the same time gas is supplied via the gas feed pipe 14 in such quantity that the desired quantity of contents together with the gas volume present in the contents wholly fill the packing container after sealing off from the packing material tube. With the help of the nozzle 15 which preferably has a diameter of 0.2–0.6 mm the mixing of gas is performed in such a manner that a large number of bubbles is formed in the contents. The bubbles are very small and uniformly distributed in the contents, so that the mixture remains substantially homogeneous during the time it takes for the contents to pass through the fill pipe 10 and flow out into the bottom end of the packing material tube 8. To compensate for the losses which occur due to a part of the gas escaping and flowing upwards through the packing material tube, the mixing of gas is done with a certain excess which has to be determined in each individual case, since it depends upon the viscosity of the product filled. In case of a desired filling ratio of 90% in the finished packing containers, somewhat more than 10% gas should therefore be supplied to the contents. It has been found that a typical value for the amount of excess gas is 50% in case of relatively mobile contents such as e.g. milk, which means that approximately 15% gas has to be added to the contents in order to obtain a filling ratio of 90% in the finished packing containers.

Experimental work has shown, moreover, that for the filling of standard milk with a fat content of 1.5–3% it is appropriate to feed gas at a pressure of approximately 3–4 bar through a nozzle with a diameter of 0.2 to 0.6 mm, preferably 0.4 mm. In this way a great number of well distributed gas bubles with an average diameter of approximately 50μ are obtained. The absolute majority of bubbles has a diameter within 30–80μ which means that the uniform distribution of the gas bubbles in the contents remains substantially unaltered during the forming process. Only 15 to 20 minutes after the mixing in of the gas a marked redistribution has taken place in that the bulk of the bubles has moved to the upper part of the finished packing container.

The quantity of gas added can be regulated accurately in that the blowing in of gas via the gas feed pipe 14 is controlled continuously and is regulated as a function of the quantity of contents which flows through the fill pipe 10. The gas used must be of such a quality that it does not react with, or in some other manner influence, the contents proper. In most cases the gas can consist of sterile air, but for certain contents, e.g. fruit juices, an inert gas, such as e.g. nitrogen, is preferred.

As mentioned earlier, an accurate and homogeneous mixing in of the gas bubbles into the contents passing through the fill pipe 10 is assured by feeding the gas through a nozzle of small diameter and by feeding under high pressure. As a result the gas is mixed in with the contents in such a manner that the contents substantially obtain a foam-like character. An alternative method of mixing the gas and the contents includes providing the fill pipe with an internal ejector nozzle at the place where it joins the gas feed pipe. With such an ejector nozzle the flow of contents will regulate automatically the desired mixing in of gas into the contents, which is an advantage, since the gas no longer has to be fed under pressure. In cases where sterile air can be used, this also means that the gas can be taken directly from the sterile air system of the packing machine without utilizing a gas storage and compressor.

The method in accordance with the invention can be used in aseptic as well as in non-aseptic conditions, that is to say in the filling of sterile milk as well as of standard (pasteurized ) milk. In aseptic manufacture it is essential that the pressure medium supplied should be constituted of a sterile gas, e.g. sterile air, which does not spoil the otherwise sterile filling conditions. Experiments have shown that this is readily possible and that aseptic packing containers of normal long life can be manufactured without any difficulty.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. A method for manufacturing and filling packing containers, comprising the steps of:

forming a tube from a continuous web of packing material and advancing said tube continuously downwardly in a vertical direction;

conducting a liquid continuously into said tube through a delivery pipe having an outlet for the liquid;

supplying a gas at a predetermined rate to said delivery pipe upstream from said outlet to produce a foamed mixture of said gas and said liquid in predetermined proportions;

filling said tube with said foamed gas-liquid mixture from said pipe to a predetermined level above said outlet;

compressing a first portion of the tube together and sealing the tube at a location below said predetermined level;

shaping a second portion of said tube into a packing container, said second portion of said tube being between said first portion and said predetermined level; and subsequently compressing a third portion of the tube together and sealing said third portion of said tube at a location between said predetermined level and said second portion; whereby said liquid contents subsequently settle and the gas forms an air space in said container according to said predetermined proportions.

2. The method in accordance with claim 1, wherein the mixing of gas with the contents is achieved by injecting the gas through a nozzle into the contents.

3. The method in accordance with claim 1, wherein a certain excess of gas is mixed in with the contents to compensate for losses during the conversion of the packing material tube to individual packing containers.

4. The method in accordance with claim 1, wherein the gas is sterile air.

5. The method in accordance with claim 1, wherein the gas is an inert gas, preferably nitrogen.

6. The method in accordance with claim 1, wherein the gas is pressurized to a pressure of 3–4 bar.

7. An apparatus for manufacturing and filling packing containers comprising:

means for feeding a continuous web in a vertical direction and for shaping said continuous web into a tube;

means for sealing a first portion of said tube at a transverse zone thereof so as to form the bottom of a packing container;

a first feed pipe for continuously conducting liquid contents into said tube and terminating adjacent said transverse zone;

a second feed pipe connected to said first feed pipe at a location exterior of said tube for continuously supplying a pressurized gas to the first feed pipe and for mixing the gas and liquid contents in said first feed pipe in predetermined proportions to form a foamed mixture;

an extension of said first feed pipe delivering said foamed mixture and filling said tube to a predetermined level in said tube above said transverse zone;

means for shaping a second portion of said tube into a packing container while said mixture fills said tube to said predetermined level, said second portion of said tube being between said first portion and said predetermined level; and means for sealing a third portion of said tube at a location between said predetermined level and said second portion to form said packing container having a top portion below said predetermined level so as to fill the container with the liquid contents and the gas defining a predetermined headspace.

8. The apparatus in accordance with claim 7 wherein a nozzle is provided in said second feed pipe.

9. The apparatus in accordance with claim 8 wherein the nozzle is an injection nozzle.

10. The apparatus in accordance with claim 8 wherein the nozzle has an internal diameter in the range of 0.2 to 0.6 mm.

11. The apparatus in accordance with claim 7 wherein the means for shaping and means for sealing said packing container includes a first pair of reciprocating jaws.

12. The apparatus in accordance with claim 11 wherein said means for sealing said tube includes a second pair of reciprocating jaws attached to said first pair of reciprocating jaws.

* * * * *